US006224235B1

(12) United States Patent
Parker

(10) Patent No.: US 6,224,235 B1
(45) Date of Patent: May 1, 2001

(54) MARKER FLASHLIGHT

(75) Inventor: David Parker, Torrance, CA (US)

(73) Assignee: Pelican Products, Inc., Torrance, CA (US)

( * ) Notice: Subject to any disclaimer, the term of this patent is extended or adjusted under 35 U.S.C. 154(b) by 0 days.

(21) Appl. No.: 09/399,309

(22) Filed: Sep. 20, 1999

(51) Int. Cl.[7] ..... F21L 4/00
(52) U.S. Cl. ..... 362/190; 362/396; 362/191
(58) Field of Search ..... 362/190, 191, 362/202, 205, 206, 208, 396, 800

(56) References Cited

U.S. PATENT DOCUMENTS 4,047,150 * 9/1977 Kelley ..... 362/191
4,234,913 * 11/1980 Ramme ..... 362/202
4,800,469 * 1/1989 Leon ..... 362/205
5,510,963 * 4/1996 Bamber et al. ..... 362/190

* cited by examiner

*Primary Examiner*—Y. Quach
(74) *Attorney, Agent, or Firm*—Oppenheimer, Wolff & Donnelly LLP

(57) ABSTRACT

A flashlight includes a battery. There is a helical spring at the base of the body. A light emitting element is mounted relative to the body. There is a switching element for opening and closing a circuit between the battery and the light emitting element. There are at least three elements for releasably securing the light to a support, each element permitting the body to be located with the support in a different manner. An electric circuit permits for periodic flashing of the light emitting element, LED.

21 Claims, 4 Drawing Sheets

12
42
10
11
24
41
19
16
40
16
27
18
26
29
28
30
17
15
34
21
31
41
40
32
20

MARKER FLASHLIGHT

BACKGROUND OF THE INVENTION

This invention relates to a marker flashlight. In particular, it relates to a flashlight for portability and carriage on a being or a body in a manner which is not hand held.

Many flashlight configurations are known. Additionally, different flashlight configurations are known which can be clipped onto clothing or be used with an animal or pet. The various known flashlights are often not as simple to manufacture as desirable, nor as versatile as necessary for use on or with living beings or with inanimate objects.

The invention is directed to provide a flashlight which minimizes the disadvantages of known marker flashlights.

SUMMARY OF THE INVENTION

By the present invention, there is provided a flashlight which minimizes the disadvantages of known marker flashlights.

According to the invention there is provided a portable marker light intended to be carried on a being or inanimate body in a hands-free manner. The flashlight comprises a body for locating a battery, a light emitting element mounted relative to the body, and a switching element. There is a spring, which when moved under the action of the switching element, permits closure of an electric circuit between a battery and the light emitting element.

There are at least two elements for securing the light to the being or body. There is preferably also a third element for securing the light.

An electric circuit includes circuitry for permitting periodic flashing of the light emitting element, and the light emitting element is preferably an LED. The switching element is at least partly a lens cover for the light emitting element.

The spring includes a helical spring in a base of the housing. A first portion of the helical spring is connectable through a conductive strip to one side of a pair of batteries, and a second portion of the spring is connectable through a conductive strip to a circuit board which is part of the electric circuit. There is also a leaf spring between the top of the pair of batteries, which are arranged in series, and the circuit board.

The invention is further described with reference to the accompanying drawings.

DETAILED DESCRIPTION OF THE PREFERRED EMBODIMENT

Figure 1:
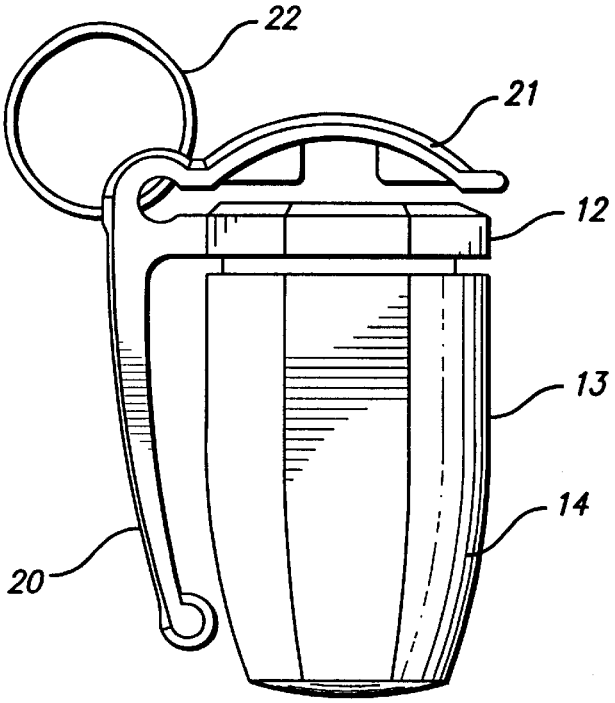
FIG. 1 is a side view of the marker flashlight.
Figure 2:
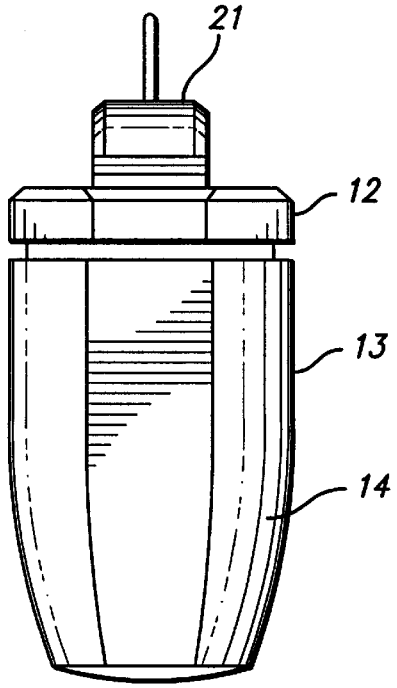
FIG. 2 is a side view, similar to FIG. 1 but turned relatively through 90°, of the flashlight.
Figure 3:
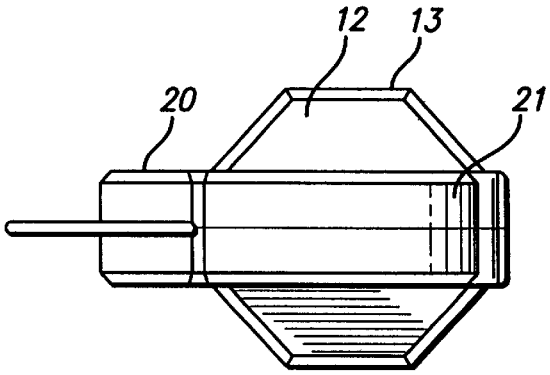
FIG. 3 is a top view of the flashlight, without the ring securing the element.

A marker flashlight includes a body 10 which has a substantially regular outer circular cross-sectional area or face 11 as defined between the base 12 of the body 10 and the top portion of the body as defined in the area 112. Around the body portion 10, which is a barrel, there is a lens portion 13 which has faces 14 which form an octagonal shape in cross section relative to the barrel 10. Within the lens 13 there is a light-emitting element, namely an LED bulb 15.

The portable marker light is intended to be carried on an animal or human being or inanimate body. Within a housing 16 there is located a pair of batteries 17 and 18 connected in series. The LED 15 is mounted on the housing 16 relative to the body 10. A switching element constituted by the lens 13, in part is also part, of the system.

There is a helical spring 19, which when moved under the action of the lens switching element 13, acts to permit closure of an electric circuit between the battery pair 17 and 18 and the light emitting element 15.

The electric circuit includes circuitry for permitting periodic flashing of the LED 15. The lens 13 cover includes an internally threaded skirt 23, and the body 10 includes an externally threaded portion 24. The threaded interengagement of the skirt 23 and the portion 24 and the relative axial interaction selectively effects opening and closure of the electric circuit. The lens 13 is a red transparent material thereby permitting for the creation of a flashing red lighting effect.

The helical spring 19 is located at the a base 12 of the body 10. A first portion of the helical spring 19 is connectable to one side 26 of the battery pack 18, and a second portion of the spring is connectable to an elongated conduction strip 27 and through this to a circuit board 28 which is part of the electric circuit. There is a leaf spring 29 between the top 30 of a pair of batteries which are arranged in series and the circuit board 28.

The LED 15, circuit board and batteries 17 and 18 are mounted in the housing 16, and the housing 16 is located in the body 10. The helical spring 19 is located between the body 10 and the housing 16.

There are at least two elements 20 and 21, and preferably a third element 22 or more for securing the light to a being or inanimate body. When used on a human the light is secured to apparel, such as clothing, a belt, cap or the like. Where the being is an animal it is secured to a device being worn or carried by the animal. This can be for instance a dog collar. When used on an inanimate body it is clipped to the vehicle, body or the like.

At least one of the elements for securing the light relative to the body is a resilient elongated clip or hook 20 directed from the base 12 in a direction over at least part of a lens 13 for covering the light emitting element 15. At least one of the elements for securing the light relative to the body is a clip or hook 21 directed along a base 12 in a direction transverse to a general axial direction of the light. At least one of the elements for securing the light relative to the body is a ring 22 attached in a hole 31 formed in the base 12 of the body 10.

The clip 20 is located substantially at the lower most portion of the body portion 10 and extends upwardly along the surface towards the lens portion 13 around the outside of the body portion 10. The clip 20 provides a receiving area 32 for receiving an inanimate support, for instance on a human or animal for the flashlight. The end of the clip 20 includes an inwardly directed lip 33 which closes the gap between the surface of lens 13 and the clip 20. Clip 21 is a similar configuration with a space 34 for receiving a support.

The ring 22 is used as required, and can be a spring like element with a closable gap to permit location or securing on a suitable feature, such as another ring, a hole, loop in clothing or the like. The ring 22 can be opened and closed as necessary. The spring-type material can have a portion overlapping and can receive in a secure manner articles of clothing or elements on a human or animal to which the marker light needs to be secured.

The housing 16 includes a C-shaped base section 35 and a C-shaped top section 36. The sidewall 37 is also relatively C-shaped, and the conductive strip 27 runs up the sidewall. The open portion of the C-shape is such that the two batteries 17 and 18 can be accommodated in the housing 16 as required. There is also a recessed slot 38 running longitudinally relative to the housing and an aperture 39. The conductive strip 27 is accommodated in that slot and passes through the aperture 39 to the electric circuitboard 28. Another C-shaped portion 43 is provided between the base section 35 and the top section 36 for receiving the batteries 17 and 18 between the top section 36 and the C-shaped portion 43.

Figure 9:
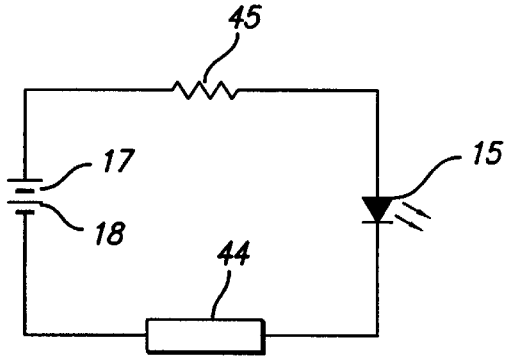
FIG. 9 is a flow diagram of the circuitry for operating the light-emitting diode.

The operation of the circuitry for the LED 15 includes a circuit having a microprocessor 44 in series circuit with the two batteries 17 and 18, a resistor 45 and the LED 15. The microprocessor 44 operates in a conventional on/off switching mode to effect opening and closure of the circuit and have flashing of the LED 15. The circuit in FIG. 9 is shown in the closed circuit.

Figures 4, 5A:
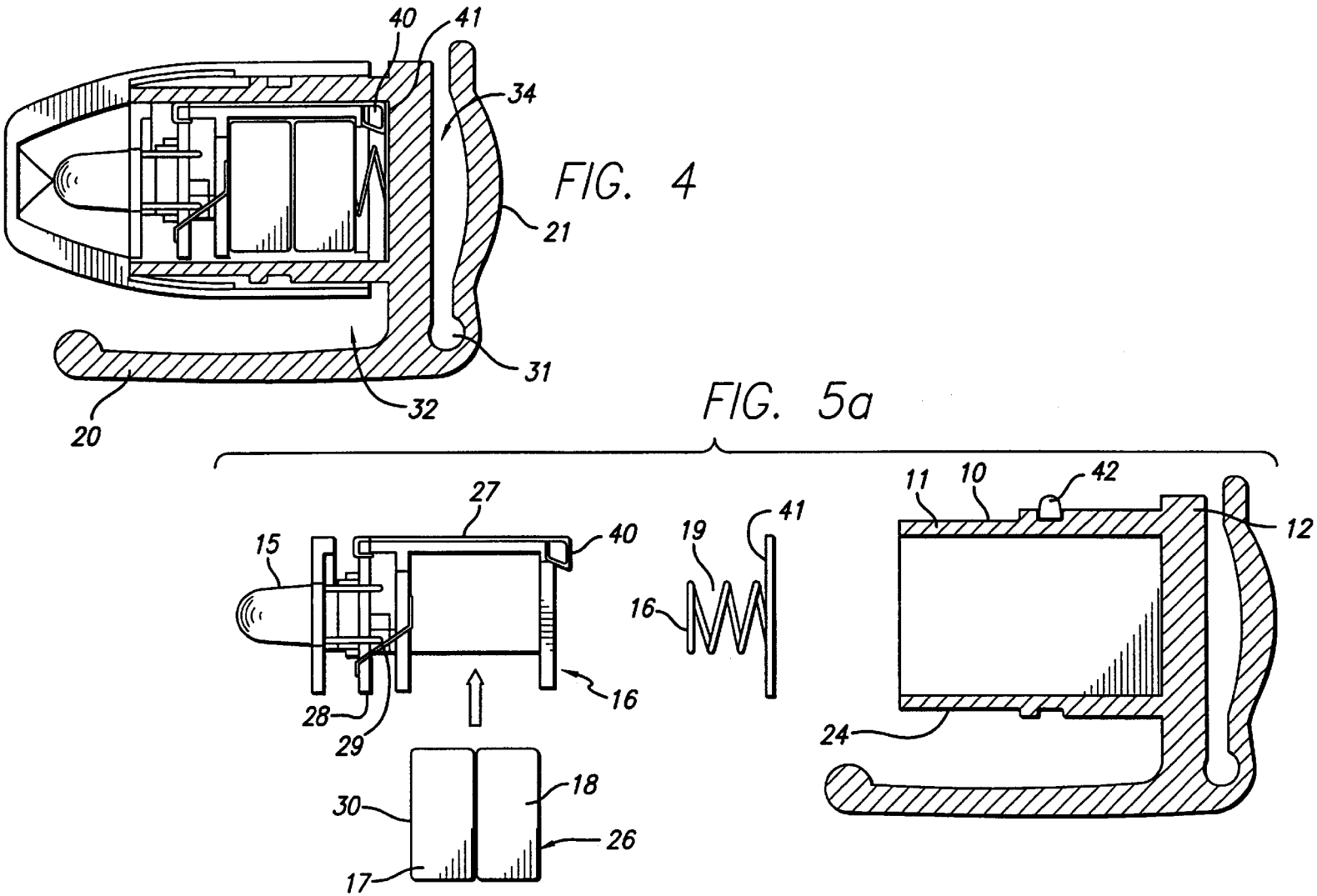
FIG. 4 is a cross-sectional side view of the marker light with the lens in the contracted position, namely the "on" position for the light-emitting element.
FIG. 5*a* is a side view of the body, the spring, a housing with a light-emitting electrode and a battery.
Figure 5B:
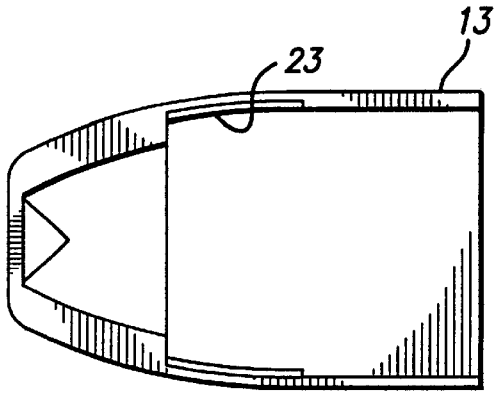
FIG. 5*b* is a side view of a lens.
Figure 5C:
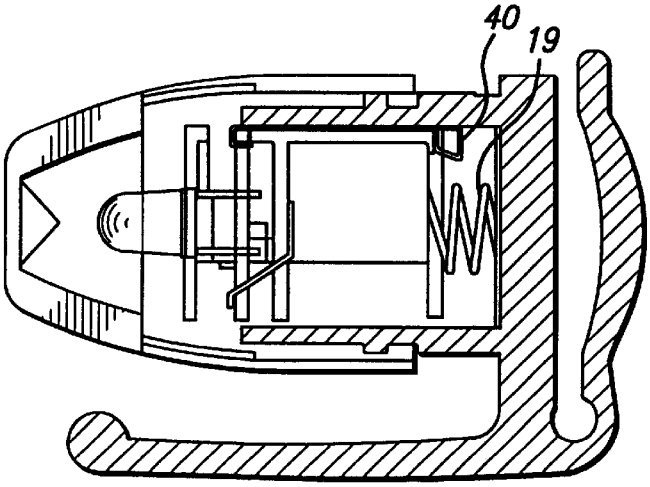
FIG. 5*c* is a cross-sectional side view of the marker light with a lens in the extended position, namely the "off" position.
Figure 6:
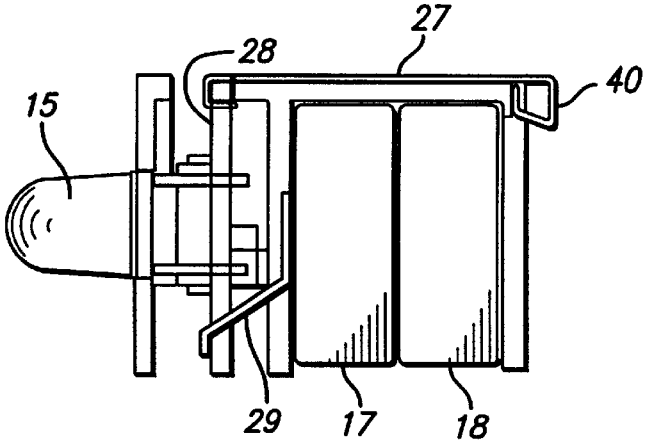
FIG. 6 is a side view of the housing with a light-emitting diode and a circuit# board between the battery pair and the light-emitting diode.
Figure 7:
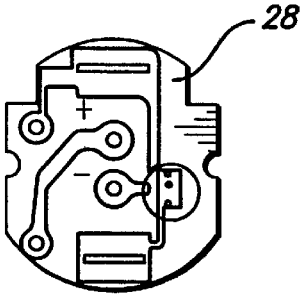
FIG. 7 is a top view of one side of the circuitboard.
Figure 8A:
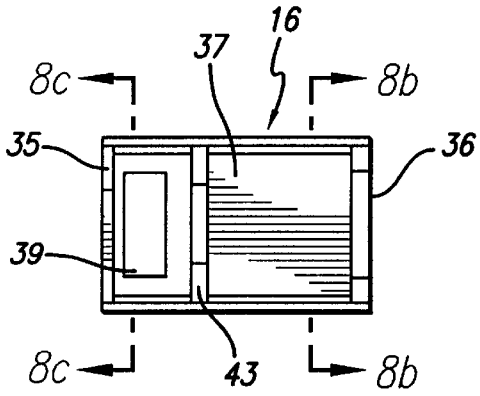
FIG. 8*a* is a side view of the housing for the batteries.
Figure 8B:
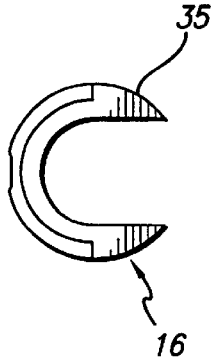
FIG. 8*b* is an end view of one end of the housing.
Figure 8C:
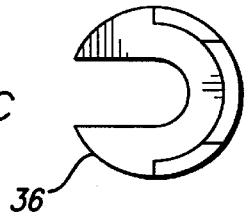
FIG. 8*c* is an end view of the opposite end of the housing.
Figure 8D:
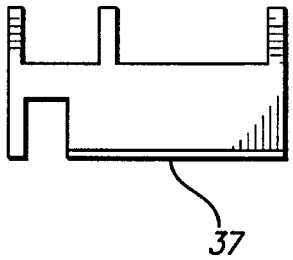
FIG. 8*d* is a side view through 90° of the housing shown in FIG.8*a*.
Figure 8E:
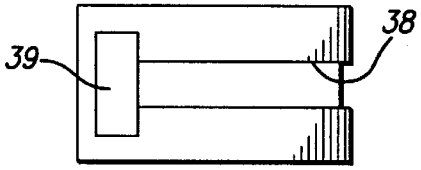
FIG. 8*e* is a side view through 180° relative to FIG. 8*a* of the housing.

The arrangement of the invention is one that as the lens 13 moves axially downwardly towards the base 12, the spring 19 is compressed so that the end portion tip 40 of strip 27 contacts the end portion 41 of the helical spring 19. This closes the electrical circuit which includes a circuitboard 28 and the LED 15. Suitable flashing of LED 15 can be effected. As illustrated in FIG. 4, the spring 19 is compressed and the tip 40 of the conductor strip has made contact with the portion 41 of the spring 19. As illustrated in FIG. 5*c*, the spring 19 is a decompressed state, and the end 40 is removed from the edge 41 of the spring 19. In this position the LED is not operated because the electric circuit is open. As such, the axial movement of the lens 13 up and down the body 10 effects the switching action of the marker light. There is also provided a sealing O-ring 42 on the outside of the slot on the body 10. This seals with the inside of the lens 13 below the threaded portion skirt 23, and this can effectively create a seal against the elements as required.

Many other forms of the invention exist, each differing from the other in matters of detail only.

The body 10 and lens 13 and assembled components may be formed from material sufficiently sturdy to be resilient to shock. Instead of helical spring on the one end of one of the batteries, there can be other different spring formations or elements, for instance leaf springs to provide effective contact characteristics and closure of the electrical circuit to either side of the batteries.

Generally, the configuration of the components is of the nature that the units can be relatively water impermeable and, in this manner, the configuration of the components are tight fitting and of a material such that the ingress of water into the inner workings and compartments of the battery is relatively difficult. The batteries may be replaced by a rechargeable battery system. In other cases only a single battery or more than two batteries may be used. In some cases the housing within the barrel may be unnecessary. Also, different switching mechanisms are possible, for instance, not related to movement of the lens. An on-off switch of the press button or linear on swivel motion may be used.

The invention is to be determined solely upon the following claims.

What is claimed is:

1. A portable marker light intended to be carried on a being comprising:

a body for locating a battery;

a light emitting element mounted relative to the body;

a switching element;

an electric circuit between the battery and the light emitting element;

a spring, when moved under the action of the switching element, acting to permit closure of the electric circuit between the battery and the light emitting element, the switching element being operably located with the electric circuit, battery and light emitting element;

at least two elements for securing the body to the being in respectively different relationships of the body and the being;

the electric circuit includes circuitry for permitting periodic flashing of the light emitting element; an wherein the one element is a first elongated clip directed in a first direction relative to the body, and the second element is a second elongated clip directed in a transverse direction relative to the first elongated clip.

2. A portable marker light as claimed in claim 1 including a third element for securing the body to the being to a device being worn or carried by the being.

3. A portable marker light as claimed in claim 1 wherein the light emitting element is an LED.

4. A portable marker light as claimed in claim 1 wherein the switching element interacts with a lens cover for the light emitting element, and wherein the lens cover includes a threaded skirt for location with a housing for the body, and the housing includes a threaded barrel, the threaded interengagement of the skirt and barrel and the relative axial interaction as the lens cover moves axially relative to the housing when the lens cover is related by the interaction of the threaded skirt on the threaded barrel selectively effecting opening and closure of the electric circuit as the axial movement acts to cause movement of the switching element.

5. A portable marker light as claimed in claim 4 wherein the lens cover is a red transparent material thereby permitting for creation of a flashing red lighting effect.

6. A portable marker light as claimed in claim 1 wherein the spring is a helical spring in a base of a housing, a first portion of the helical spring is connectable to one side of the battery, and wherein a second portion of the spring being connectable to a circuit board which is part of the electric circuit.

7. A portable marker light as claimed in claim 6 including an elongated conductive strip for location between the helical spring and the circuit board in a manner so as permit opening and closure connection of the electric circuit in response to action of the switching element.

8. A portable marker light intended to be carried on a being comprising:

a body for locating a battery;

a light emitting element mounted relative to the body;

a switching element;

an electric circuit between the battery and the light emitting element;

a spring, when moved under the action of the switching element, acting to permit closure of the electric circuit between the battery and the light emitting element, the switching element being operably located with the electric circuit, battery and light emitting element; and at least two elements for securing the body to the being in respectively different relationships of the body and the being;

the electric circuit includes circuitry for permitting periodic flashing of the light emitting element;

the spring is a helical spring in a base of a housing, a first portion of the helical spring is connectable to one side of the battery, and wherein a second portion of the spring being connectable to a circuit board which is part of the electric circuit; and a leaf spring between a top of the battery and the circuit board, and wherein a bottom of the battery is connected to the helical spring.

9. A portable marker light intended to be carried on a being comprising:

a body for locating a battery;

a light emitting element mounted relative to the body;

a switching element;

an electric circuit between the battery and the light emitting element;

a spring, when moved under the action of the switching element, acting to permit closure of the electric circuit between the battery and the light emitting element, the switching element being operably located with the electric circuit, battery and light emitting element; and at least two elements for securing the body to the being in respectively different relationships of the body and the being;

the electric circuit includes circuitry for permitting periodic flashing of the light emitting element;

the spring is a helical spring in a base of a housing, a first portion of the helical spring is connectable to one side of the battery, and wherein a second portion of the spring being connectable to a circuit board which is part of the electric circuit; and wherein the light emitting element, circuit board and battery are mounted in the housing, the housing being located in the body.

10. A portable marker light comprising:

a body for locating a battery;

a light emitting element mounted relative to the body;

a switching element located between the battery and light emitting element for operably opening and closing an electric circuit between the battery and the light emitting element;

at least three elements for releasably securing the body to a support, each element permitting the body to be located with the support in a different manner; and a helical spring in a base of a housing for the body, a first portion of the helical spring being connectable to one side of the battery, and wherein a second portion of the spring is connectable to a circuit board which is part of the electric circuit, the electric circuit permitting periodic flashing of the light emitting element, a leaf spring between a top of the battery and the circuit board, and wherein a bottom of the battery is connected to the helical spring.

11. portable marker light as claimed in claim 10 wherein the switching element interacts with a lens cover for the light emitting element, and wherein the lens cover includes a threaded skirt for location with a housing for the body, and the housing includes a threaded barrel, the threaded interengagement of the skirt and barrel and the relative axial interaction as the lens cover moves axially relative to the housing when the lens cover is related by the interaction of the threaded skirt on the threaded barrel selectively effecting opening and closure of the electric circuit as the axial movement acts to cause movement of the switching element.

12. A portable marker light as claimed in claim 10 wherein at least one of the elements for securing the body is a clip directed along a base in a direction longitudinal to a general axial direction of the light.

13. A portable marker light as claimed in claim 12 wherein at least one of the elements for securing the body is a clip directed along a base in a direction transverse to a general axial direction of the body.

14. A portable marker light as claimed in claim 13 wherein at least one of the elements for securing the body is a ring attached in a hole formed in the base of the body.

15. A portable marker light comprising:

a body for locating a battery;

a light emitting element mounted relative to the body;

a switching element located between the battery and light emitting element for operating opening and closing an electric circuit between the battery and the light emitting element;

at least three elements for releasably securing the body to a support, each element permitting the body to be located with the support in a different manner; and at least one of the elements for securing the body is a resilient elongated clip directed from a base in a direction over at least part of a lens for covering the light emitting element, and the electric circuit permitting periodic flashing of the light emitting element.

16. A portable marker light as claimed in claim 15 wherein at least one of the elements for securing the body is a ring attached in a hole formed in the base of the body.

17. A portable marker light comprising;

a body for locating a battery;

a light emitting element mounted relative to the body;

a switching element located between the battery and light emitting element for operating opening and closing an electric circuit between the battery and the light emitting element; and at least three elements for releasably securing the body to a support, each element permitting the body to be located with the support in a different manner, and wherein two of the elements are respectively elongated clips, each clip being directed in a relatively different direction relative to the body.

18. A portable marker light as claimed in claim 17 wherein at least one of the elements for securing the body is a clip directed along a base in a direction longitudinal to a general axial direction of the light.

19. A portable marker light as claimed in claim 18 wherein at least one of the elements for securing the body is a clip directed along a base in a direction transverse to a general axial direction of the body.

20. A portable marker light as claimed in claim 19 wherein at least one of the elements for securing the body is a ring attached in a hole formed in the base of the body.

21. A portable marker light as claimed in claim 17 wherein at least one of the elements for securing the body is a ring attached in a hole formed in the base of the body.

* * * * *